United States Patent [19]

Morishita et al.

[11] Patent Number: 5,039,967

[45] Date of Patent: Aug. 13, 1991

[54] MAGNETIC SWITCH

[75] Inventors: Akira Morishita; Shuzou Isozumi, both of Himeji, Japan

[73] Assignee: Mitsubishi Denki Kabushiki Kaisha, Tokyo, Japan

[21] Appl. No.: 499,912

[22] Filed: Mar. 23, 1990

[30] Foreign Application Priority Data

Mar. 24, 1989 [JP] Japan ..... 1-72620

[51] Int. Cl.[5] ..... H01H 7/02

[52] U.S. Cl. ..... 335/131; 335/126

[58] Field of Search ..... 335/126, 131, 6, 280

[56] References Cited

U.S. PATENT DOCUMENTS 4,016,518 4/1977 Lang et al. ..... 335/8
4,760,274 7/1988 Isozumi .
4,816,712 3/1989 Tanaka .
4,852,417 8/1989 Tanaka ..... 335/131

FOREIGN PATENT DOCUMENTS 1311876 11/1962 France .

*Primary Examiner*—Leo P. Picard
*Assistant Examiner*—Lincoln Donovan
*Attorney, Agent, or Firm*—Sughrue, Mion, Zinn, Macpeak and Seas

[57] ABSTRACT

A magnetic switch wherein a core flange 22a is so formed as to always confront the outer peripheral surface of a cylindrical plunger 23 while the plunger is being shifted in a direction from the flange to another core member 4a by the magnetic attraction force, thereby to prevent the magnetic attraction force from generating in a direction reverse to that the plunger is to be shifted.

2 Claims, 4 Drawing Sheets

MAGNETIC SWITCH

BACKGROUND OF THE INVENTION

1. Field of the Invention

The present invention relates to a magnetic switch for use mainly in a coaxial type starter to start an engine.

2. Description of Related Art

As a conventional coaxial type starter device for starting an engine, one structured as disclosed in Japanese Patent Application Laid Open No. 63-140864 (1988) has been well known. FIGS. 1 and 2 show sectional views of a magnetic switch employed in the conventional coaxial type starter device. FIG. 1 represents a case where a plunger 7 which will be described later is at a stationary or rest position, while FIG. 2 represents a case where the plunger is at a fully shifted position.

In FIGS. 1 and 2, a reference numeral 1 designates a rear end portion of a direct current motor which produces starting torque for an engine. A magnetic switch 2 is provided at the rear end side of the motor 1, which is coupled to an armature shaft (not shown) of the motor 1. The armature shaft is coupled at the front end side of the motor 1 to an output shaft transmitting the rotation of the motor 1 to the engine. The magnetic switch 2 not only slides the output shaft, but allows power supply from a battery to the motor 1 when a key switch of a vehicle is turned on.

The magnetic switch 2 has an iron casing 3 outside, in which an annular front core **4*a* and an annular rear core 4*b* form a magnetic path together with the casing 3, at the front end in contact with the motor 1 and at the rear end thereof respectively. An inner periphery of the rear core 4*b* projects towards the front core 4*a* thereby to form a cylindrical portion 4*c*. The length of the cylindrical portion 4*c* is equal to the length in the axial direction of an outer peripheral surface of the plunger 7** described later.

Between the front and rear cores **4*a* and 4*b* is provided a plastic hollow bobbin 5 wound with an exciting coil 6. The bobbin 5 insulates the exciting coil 6 from the front and rear cores 4*a* and 4*b*. A cylindrical plunger 7 is slidably arranged in the hollow at the center of the bobbin 5. A plunger restoring spring 17 is provided between the front end of the plunger 7 and the front core 4*a* so as to restore the plunger 7 from the fully shifted position to the stationary position. When the plunger 7 is in the stationary position as shown in FIG. 1, the peripheral surface of the plunger 7 confronts the whole peripheral surface of the cylindrical portion 4*c* of the rear core 4*b*. When the plunger 7 is fully shifted frontward as shown in FIG. 2, merely a slight peripheral portion at the rear end of the plunger 7 confronts the front end of the peripheral surface of the cylindrical portion 4*c***.

The inner periphery at the rear end of the plunger 7 is integrally formed with an intermediate plate **7*a*, in the center of which is coupled one end of a plunger rod 8. Another end of the plunger rod 8 enters the hollow armature shaft from the rear end of the motor 1 to be coupled with a middle rod (not shown) inside the hollow of the armature shaft. The plunger rod 8 transmits the shifting force of the plunger 7 to the output shaft via the middle rod. Around the plunger rod 8 at the coupled side to the intermediate plate 7*a* is fitted a sleeve 9. A traveling contact point 11 is so held around the sleeve 9 having an insulating body 10 therebetween as to be slidable in the axial direction of the plunger rod 8**.

In the magnetic switch 2 having the aforementioned structure, when the exciting coil 6 is supplied power, the plunger 7 is attracted by the front core **4*a* to be shifted forward because of the magnetic attraction force by magnetic flux through the casing 3, rear core 4*b*, plunger 7 and front core 4*a*. When the plunger 7 is attracted frontward, the plunger rod 8 slides the output shaft frontward, whereby the output shaft is projected outside the coaxial type starter device. Consequently, the traveling contact point 11 held on the plunger rod 8 is brought into touch with a fixed contact point 12 provided at a predetermined position, so that a power supply circuit from the battery to the motor 1** is formed.

FIG. 3 is a graph showing the relation between the magnetic attraction force and, a gap (g) between the front end of the plunger 7 and the rear end of the front core **4*a* (plunger gap). In the graph, a curve A indicates the relation between them in the conventional magnetic switch 2 having the above-described structure, wherein as the plunger gap (g) is narrower, the rate of increase in the attraction force lowers. However, because a larger restoring force is added to the plunger 7 due to the compression of the plunger restoring spring 17 as the plunger gap (g) gets narrower, the plunger 7 cannot be attracted up to the front core 4*a*** unless the magnetic attraction force exceeds the restoring force.

Theoretically, as the plunger 7 comes nearer to the fully shifted position to narrow the plunger gap (g), an increasing rate of the magnetic attraction force the plunger 7 receives from the front core **4*a* becomes higher. In practice, on the contrary, an increasing rate of the magnetic attraction force lowers as the plunger gap (g) becomes narrower. The reason for this is considered as follows. As the plunger 7 is shifted frontward thereby to reduce the area of the cylindrical portion 4*c* of the rear core 4*b* confronting the plunger 7, magnetic-flux 13 as indicated in FIG. 2 is generated between the cylindrical portion 4*c* and the rear end of the plunger 7. This magnetic flux 13 acts as a reverse attraction force to pull back the plunger 7 rearward, and therefore the magnetic attraction force in a forward direction is reduced by the reverse attraction force. Without sufficient attraction force for the plunger 7**, when the source voltage lowers, for instance, a predetermined attraction force cannot be obtained.

As the first method for preventing the generation of the magnetic flux 13, it may be considered to lengthen the plunger to confront the peripheral surface thereof with the whole peripheral surface of the cylindrical portion **4*c* even when the plunger is fully shifted. However, to lengthen the plunger increases the total length of the magnetic switch 2**, which conflicts with the technology trend toward a compact but highly efficient device.

As the second method, as shown in FIG. 4, it may be considered to shorten the bobbin 5 wound with the exciting coil 6 in the axial direction to remove the cylindrical portion **4*c*. In this case, the rear core 4*b* is so positioned that when the plunger is at the stationary position, the inner peripheral surface of the rear core 4*b* faces the front end of the peripheral surface of the plunger 7, whereas, when the plunger 7 is at the fully shifted position, the rear core 4*b* confronts the rear end of the peripheral surface of the plunger 7. In this second method, no magnetic flux as in the first method is generated, however a sufficient winding number cannot be secured for the exciting coil 6. Therefore, as indicated by a curve B in FIG. 3**, although an increasing rate of the magnetic attraction force becomes higher as the plunger gap (g) becomes narrower, the initial attraction force is so small to obtain sufficient attraction force.

SUMMARY OF THE INVENTION

The present invention has been developed with a view to substantially eliminating the above-described disadvantages inherent in the prior art, and has for its essential object to provide an improved magnetic switch. In the magnetic switch of the invention, an increasing rate of the magnetic attraction force for attracting a plunger to a front core is rendered greater in accordance with a reduction in a gap between the plunger and front core.

The above and further objects and features of the invention will more fully be apparent from the following detailed description with accompanying drawings.

DESCRIPTION OF THE PREFERRED EMBODIMENTS

Figure 5:
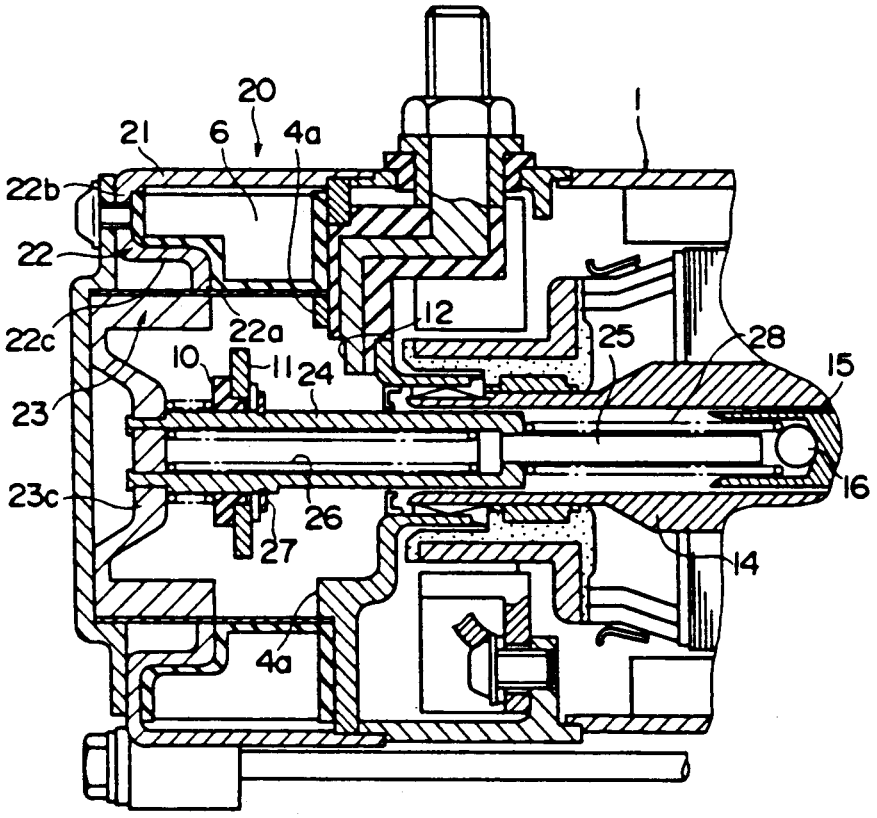
FIGS. 5 and 6 are sectional views showing the structure of a magnetic switch of the invention.
Figure 6:
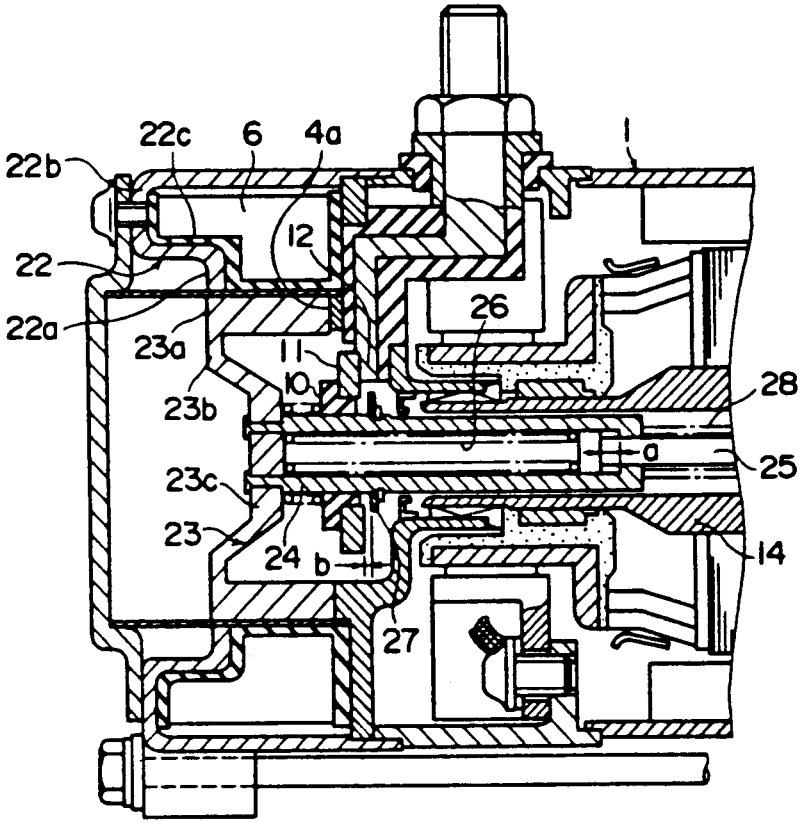

A magnetic switch according to one preferred embodiment of the invention will be discussed hereinbelow with reference to the drawings. FIGS. 5 and 6 are sectional views of the magnetic switch, FIG. 5 showing a case where a plunger 23 which will be described later is at the stationary or rest position, and FIG. 6 showing a case where the plunger 23 is at a fully shifted position.

In FIGS. 5 and 6, a reference numeral 1 indicates a rear end of a direct current motor which produces starting torque of an engine. A magnetic switch 20 is provided at the rear end side of the motor 1, which is coupled to an armature shaft 14 of the motor 1. The armature shaft 14 is coupled at the front end side of the motor 1 to an output shaft 15 transmitting the rotation of the motor 1 to the engine. The magnetic switch 20 slides the output shaft 15, and at the same time, allows power supply from a battery to the motor 1 when a key switch of a vehicle is turned on.

The magnetic switch 20 has an iron casing 21 outside. At the front end of the switch 20 in contact with the motor 1, there is provided an annular front core 4*a* which forms a magnetic path together with the casing 21. At the rear end of the switch 20, there is provided an annular rear core 22 which is integrally formed with the casing 21 to form the magnetic path.

Between the front and rear cores 4*a* and 22 is provided a plastic hollow bobbin 5 wound with an exciting coil 6. The bobbin 5 insulates the exciting coil 6 from the front and rear cores 4*a*, 22. A cylindrical plunger 23 is slidably arranged in the hollow at the center of the bobbin 5.

An inner peripheral or flange portion 22*a* of the rear core 22 is so formed as to be closer to the front core 4*a* than an outer peripheral portion 22*b*. An intermediate or ring portion 22*c* between the inner peripheral portion 22*a* and outer peripheral portion 22*b* is spaced at a suitable distance from the peripheral surface of the plunger 23 and in parallel thereto. A rear end of the outer peripheral portion 22*b* is approximately on the same plane as a rear end face 23*b* of the plunger 23 at the stationary position. An inner end of the inner peripheral portion 22*a* is opposed to a front end of the peripheral surface of the plunger 23 when the plunger is at the stationary position, and opposed to an ultimate end portion 23*a* of the peripheral surface of the plunger 23 when the plunger is at the fully shifted position.

In the inner periphery at the rear end of the plunger 23, an intermediate plate 23*c* is integrally formed with the plunger 23, in the center of which a tubular plunger rod 24 made of nonmagnetic stainless steel is fixed at a rear end thereof. An opening at a front end of the plunger rod 24 has a smaller diameter than the inside diameter of the plunger rod 24. The front end of the plunger rod 24 enters the hollow of the armature shaft 14 from the rear end of the motor 1 to be coupled to a rear end of a pressing rod 25 provided in the hollow of the armature shaft 14. The rear end of the pressing rod 25 has a larger diameter than that of the other part and that of the front opening of the plunger rod 24 to form a stopper to prevent the pressing rod 25 from slipping out of the plunger rod 24.

There is also provided a coil spring 26 between the stopper of the pressing rod 25 and the rear side of the plunger rod 24 fixed to the intermediate plate 23*c*. The front end of the pressing rod 25 faces a steel ball 16 at the inmost wall of a recess formed in the rear end of the output shaft 15. The steel ball 16 is held by a spring 28 having one end thereof fixed to the front end of the plunger rod 24. The spring 28 also serves as a restoring spring for the plunger 23.

The plunger rod 24 transmits the shifting force of the plunger 23 to the output shaft 15 through the pressing rod 25. A traveling contact point 11 is so held around the plunger rod 24 having an insulating body 10 therebetween as to be slidable in the axial direction of the plunger rod 24. A stopper 27 is provided in front of the traveling contact point 11 to stop the traveling contact point 11 sliding.

The traveling contact point 11 is relatively pressed back on the plunger rod 24 until the pressing rod 25 is brought in touch with the steel ball 16 to press the output shaft 15. When the plunger 23 is fully shifted, the traveling contact point 11 is in touch with a fixed contact point 12. In this embodiment, a distance (b) to press back the traveling contact point 11 is set smaller than a distance (a) from a point where the plunger 23 starts to return to a point where the plunger rod 24 starts to pull the rod 25 backward, namely, the distance (a) between the front end of the stopper of the pressing rod 25 and the front inner surface of the plunger rod 24 at the fully shifted position.

As is described above, in this embodiment, sufficient initial magnetic attraction force can be obtained because the length of the bobbin 5 in the axial direction is enough to obtain the sufficient winding number of the exciting coil 6. Moreover, because the plunger 23 and the rear core 22 are always opposed to each other in the same area while the plunger 23 is attracted to the fully shifted position from the stationary position, magnetic flux resulting in the reverse attraction force is never generated between the rear core 22 and plunger 23.

Figure 1:
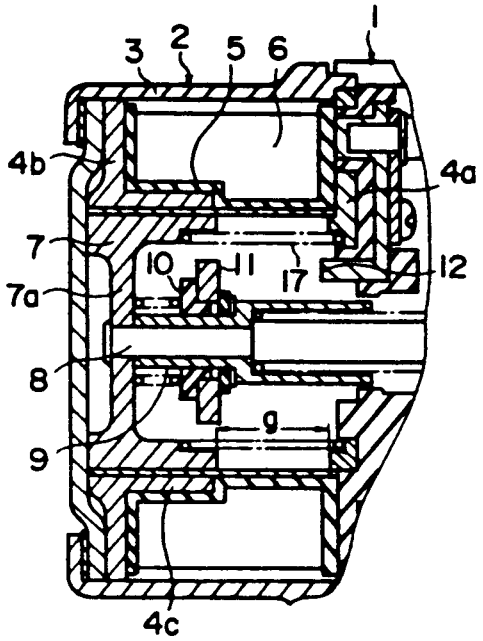
FIG. 1 Prior Art
FIGS. 1, 2 and 4 are sectional views showing the structure of conventional magnetic switches.
Figure 2:
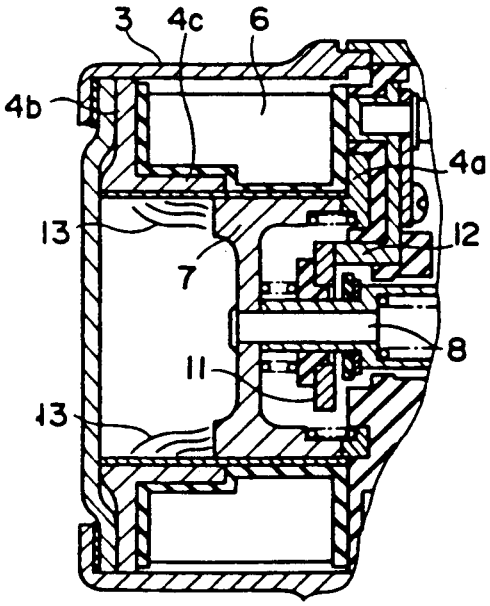
FIG. 2 Prior Art
Figure 3:
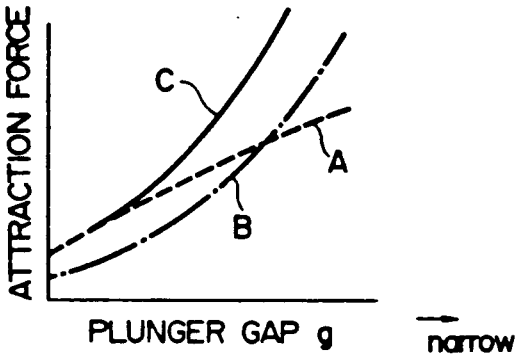
FIG. 3 is a graph showing the relation between a plunger gap and the magnetic attraction force.
Figure 4:
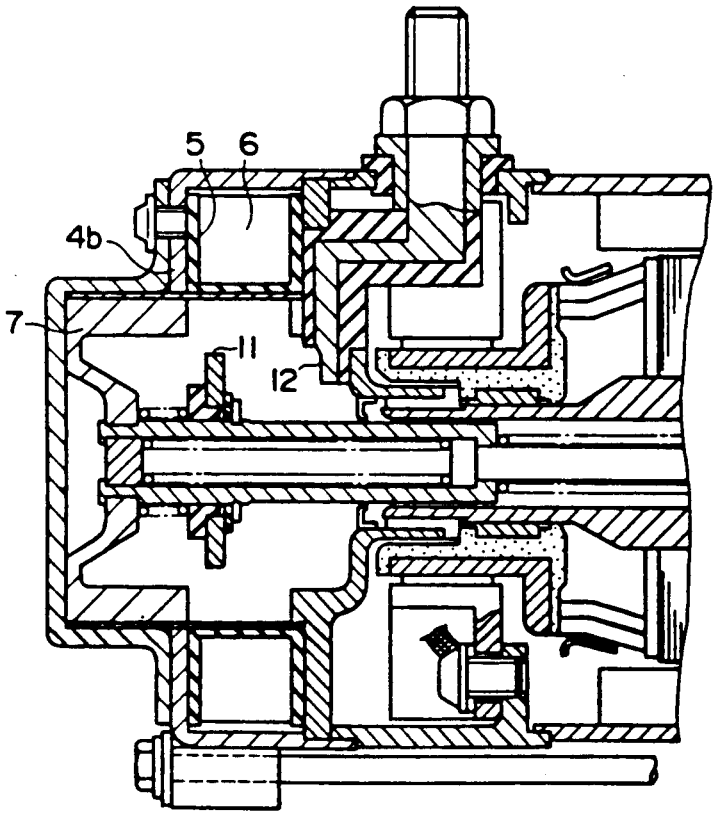
FIG. 4 Prior Art

In FIG. 3 a curve C shows the relation between the magnetic attraction force applied to the plunger 23 and the plunger gap (g) in the magnetic switch 20 of the embodiment. As is shown in the graph, the initial attraction force is approximately equal to that obtained in the conventional magnetic switch 2 indicated by the curve A. However, as the plunger 23 is shifted frontward to reduce the plunger gap (g), the increasing rate of the attraction force becomes higher in the present embodiment. Therefore, irrespective of the position of the plunger 23, the magnetic switch 20 of the invention can obtain the predetermined magnetic attraction force, thereby preventing inferior operation when the magnetic switch is applied to a coaxial type starter device.

Further, since the spring 28 for holding the steel ball 16 is also used as a restoring spring to restore the plunger 23, in place of the plunger restoring spring 17 provided outside the plunger in the conventional magnetic switch 2, the cross sectional area of the magnetic path through the plunger 23 and front, rear cores 4*a*, 22 increases, and as a result, a larger attraction force can be obtained.

In this embodiment, although the rear core 22 is integrally formed with the iron casing 21, it may be formed separately from the casing 21.

In addition, the shape of the rear core 22 is not restricted to that employed in this embodiment, but it may be any so long as to face the surface of the plunger with a constant area during the shift of the plunger from the stationary position to the fully shifted position.

As this invention may be embodied in several forms without departing from the spirit of essential characteristics thereof, the present embodiment is therefore illustrative and not restrictive, since the scope of the invention is defined by the appended claims rather than by the description preceding them, and all changes that fall within the meets and bounds of the claims, or equivalence of such meets and bounds thereof are therefore intended to be embraced by the claims.

What is claimed is:

1. A magnetic switch, comprising:

first and second annular core members (22,4*a*) disposed opposite to each other;

a hollow exciting coil (6) disposed between said first and second core members;

a plunger (23) slidably disposed within said exciting coil and shiftable in a direction from said first core member to said second core member by magnetic attraction force; and electrical contacts (11,12) opened and closed by the shift of said plunger, wherein said first core member has a radially extending inner portion (22*a*) and a radially extending outer portion (22*b*) located in different axial positions, respectively, said inner portion and outer portion lying in planes parallel to each other, said inner portion being disposed closer to said second core member than said outer portion, said inner portion being located to confront an end surface (23*a*) of said plunger when fully shifted by the magnetic attraction force, said outer portion being located on approximately the same plane as the end surface of said plunger when in an unshifted, rest position and radially spaced apart from the end surface of said plunger, and an intermediate portion (22*c*) spaced from a peripheral surface of said plunger connecting said inner portion and outer portion in the axial direction of said plunger.

2. A magnetic switch, comprising:

(a) a hollow cylindrical exciting coil (6), (b) first and second annular magnetic core members (22, 4*a*) disposed flanking opposite ends of the coil and overlying an outer periphery thereof, (c) a cylindrical plunger (23) slidably disposed within the coil and shiftable in an axial direction from a rest position underlying the first core member toward the second core member upon energization of the coil, and (d) movable and stationary electrical contacts (11,12) opened and closed by the shifting of the plunger, (e) wherein the first core member includes an axially directed ring portion (22*c*) spaced radially outwardly from and concentric with an outer cylindrical surface of the plunger, and a flange portion (22*a*) extending radially inwardly from an innermost end of the ring portion and confronting the outer cylindrical surface of the plunger in both the rest and shifted positions thereof such that leakage flux between the first core member and the plunger, tending to resist the shifting of the plunger, is minimized.

* * * * *